United States Patent [19]

Hampton

[11] 4,435,108

[45] Mar. 6, 1984

[54] METHOD OF INSTALLING SUB-SEA TEMPLATES

[75] Inventor: James E. Hampton, Peterculter, Scotland

[73] Assignee: SEDCO, Inc., Dallas, Tex.

[21] Appl. No.: 292,014

[22] Filed: Aug. 11, 1981

[51] Int. Cl.[3] ..... E02B 17/02

[52] U.S. Cl. ..... 405/209; 175/7; 405/227

[58] Field of Search ..... 405/195, 203, 209, 224, 405/227; 175/5, 7

[56] References Cited

U.S. PATENT DOCUMENTS

| | | | |
|---|---|---|---|
| 3,987,638 | 10/1976 | Burkhardt et al. | 405/203 |
| 4,062,313 | 12/1977 | Stram | 405/224 X |
| 4,194,857 | 3/1980 | Chateau et al. | 175/7 X |
| 4,273,471 | 6/1981 | Burke | 405/224 X |
| 4,351,261 | 9/1982 | Shanks | 175/5 X |

FOREIGN PATENT DOCUMENTS

| | | |
|---|---|---|
| 980575 | 1/1962 | United Kingdom . |
| 2009815 | 6/1979 | United Kingdom . |
| 2026577 | 2/1980 | United Kingdom . |
| 2054710 | 2/1981 | United Kingdom . |

*Primary Examiner*—David H. Corbin

*Attorney, Agent, or Firm*—Hubbard, Thurman, Turner & Tucker

[57] ABSTRACT

A subsea template is installed by a method which includes the steps of securing the template in a position beneath the deck of a semi-submersible drilling vessel, moving the semi-submersible drilling vessel to an appropriate offshore site and subsequently lowering the template from the semi-submersible to the sea bed. In addition, at least three anchorage templates may be loaded onto one or both of the pontoons of the semi-submersible drilling vessel at its original position and are subsequently lowered from the pontoons to their respective locations on the sea bed after the semi-submersible has moved to the offshore site.

15 Claims, 19 Drawing Figures

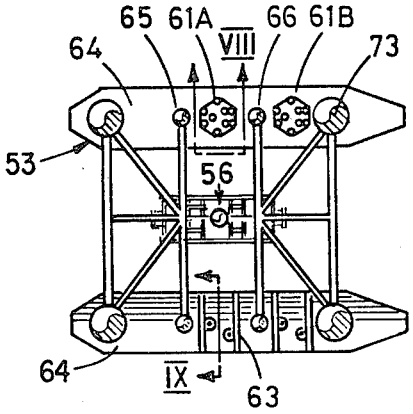
FIG. 7
FIG. 8
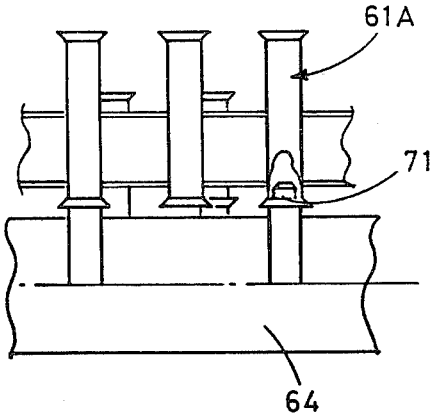
FIG. 9
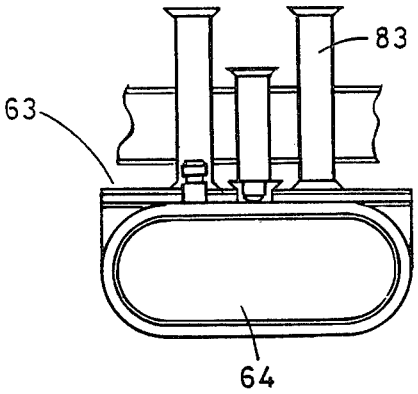
FIG. 10
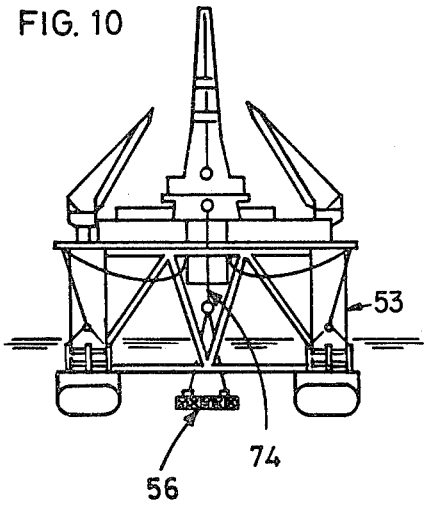
FIG. 11
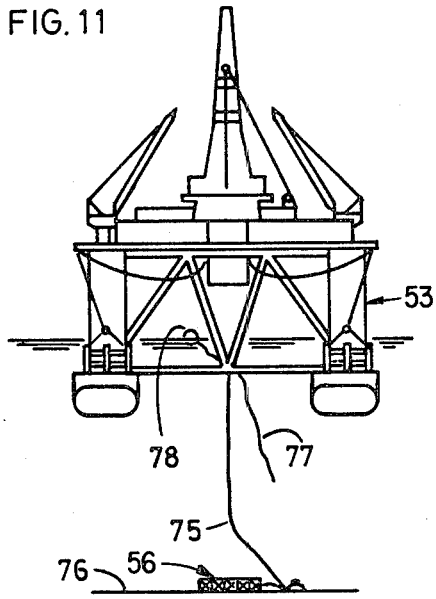

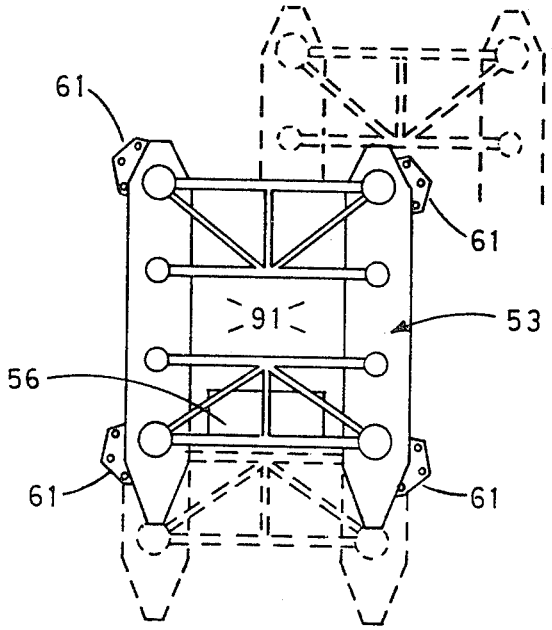
FIG. 12
FIG. 13
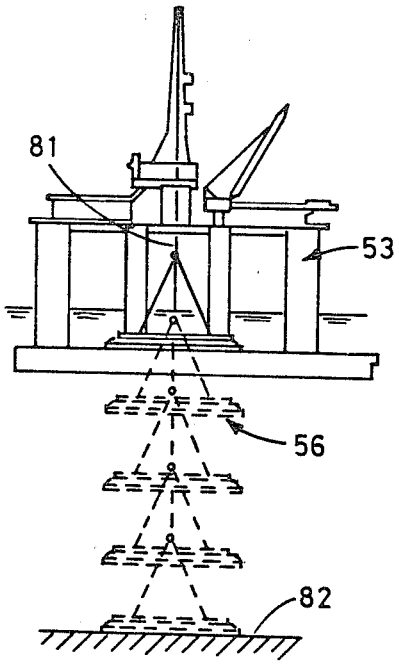
FIG. 14
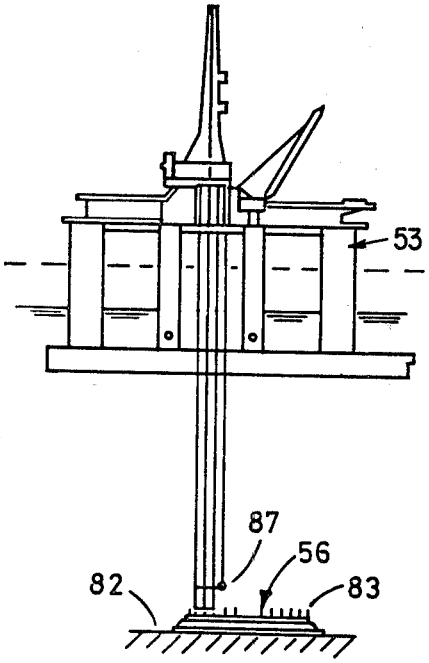

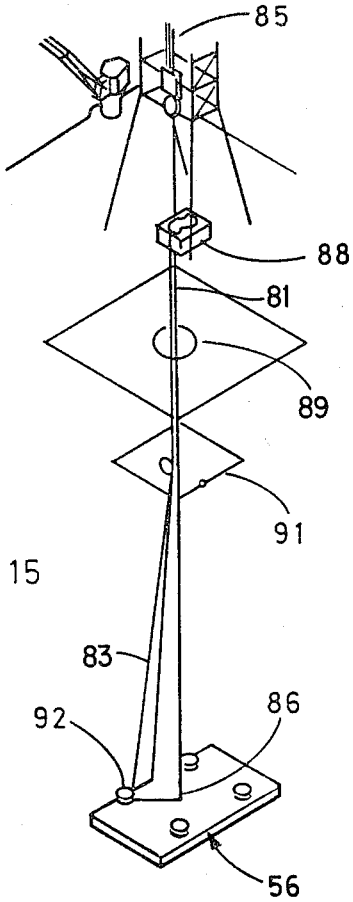
FIG. 15
FIG. 16
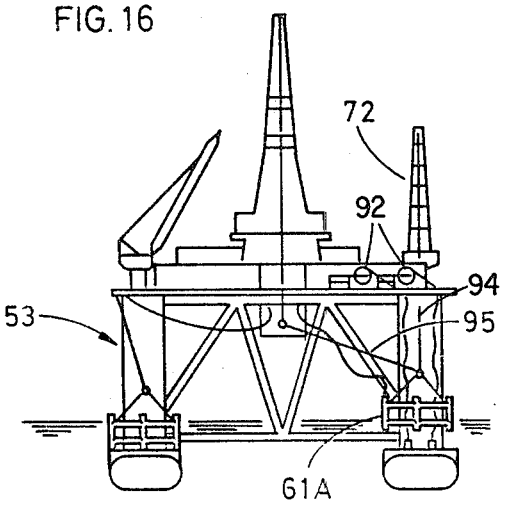
FIG. 17
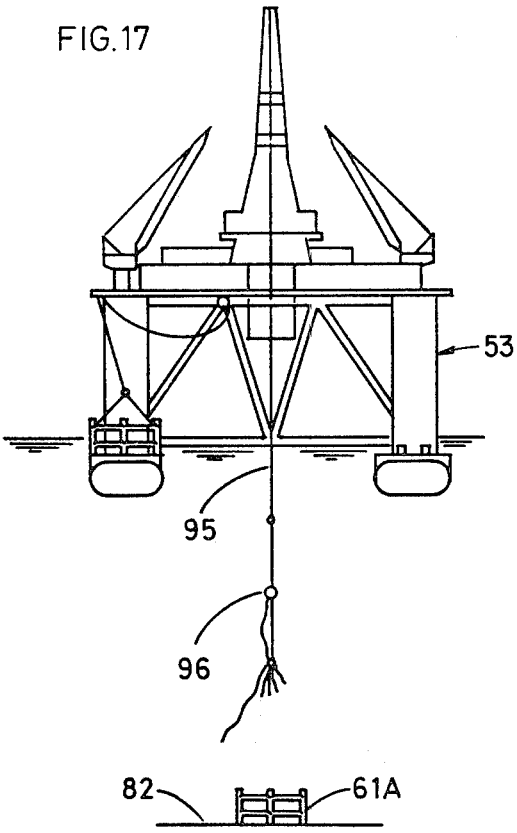
FIG. 18
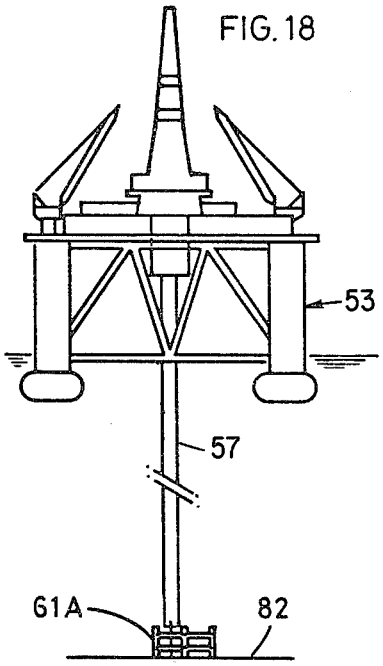

METHOD OF INSTALLING SUB-SEA TEMPLATES

BACKGROUND OF THE INVENTION

The invention relates to the transportation and installation of subsea templates.

The invention provides a method of installing a subsea template which comprises the steps of lifting the template to a position beneath the deck of a semi-submersible drilling vessel, moving the semi-submersible to an offshore site, and then lowering the template from the semi-submersible to the sea bed.

It is preferred that the template is a drilling template, and is lowered to the sea bed from beneath a drilling table of the semi-submersible.

The invention may be applied to the installation of templates for a tension leg platform.

A tension leg platform (TLP) comprises a buoyant body anchored to the sea bed at an offshore site by at least three anchorage (or foundation) templates, there being tension legs extending between the body and the templates, the length of said legs being such that the buoyancy of the body keeps all the legs under tension in all anticipated sea states.

In a particular application the invention provides a method of installing foundations for a TLP (as hereinbefore defined) which comprises the steps of loading at least three anchorage templates onto one or both of the pontoons of a semi-submersible drilling vessel, moving the semi-submersible to the site for the TLP, and then lowering the templates from the semi-submersible to their respective locations on the sea bed.

In one preferred form of the invention a drilling template is moved out to the site using the semi-submersible at the same time as the anchorage templates are moved out to the site.

In this form the drilling template may be lifted beneath the drilling table of the semi-submersible.

In a specific form the drilling template, four foundation templates, subsea pile-driving hammers and a limited number of piles for the drilling template are loaded out in one operation, with the templates loaded onto the semi-submersible in sheltered water.

The invention may include the additional step of piling the template or templates to the seabed using piling means operable from the semi-submersible.

According to a feature of the invention one or more of the templates may be levelled by means of a rotary drill string dependant from a heave compensator mounted on the semi-submersible.

According to another feature of the invention a pin pile slip assembly may be used to handle piles which are installed from the semi-submersible in order to secure one or more of the templates to the sea bed.

The invention also provides a method of levelling a subsea template which includes the step of using a heave compensator dependant from a semi-submersible to adjust the height of the template relative to a fixed pile.

The following procedures are proposed as an advantageous method to loadout, seafasten, transport and install a well drilling template and four six-pile foundation templates from sheltered water to an offshore site.

BRIEF DESCRIPTION OF THE DRAWINGS

A specific embodiment of the invention will now be described by way of example with reference to the accompanying drawings, in which:

FIG. 7 is a cutaway plan view illustrating how a drilling template and four foundation templates can be loaded onto the semi-submersible and how the foundation templates are sea fastened.

FIG. 8 is a sectional view on the line VIII in FIG. 7.

FIG. 9 is a sectional view on the line IX in FIG. 7.

FIG. 10 illustrates the semi-submersible about to deposit the drilling template on the sea bed in unfavourable weather conditions.

FIG. 11 shows a recovery chain about to be released following the deposit of the drilling template on the sea bed.

FIG. 12 is a diagrammatic plan view showing how the semi-submersible manoeuvres over the site for a tension leg platform (TLP).

FIG. 13 illustrates the installation of the drilling template at the site of the TLP.

FIG. 14 shows the formation of a hole for a grouted pile.

FIG. 15 is a diagram indicating how a heave compensator is used to level the drilling template.

FIG. 16 shows how a foundation template is unshipped from the hull of the semi-submersible.

FIG. 17 shows the installation of that template at the site of the TLP.

FIG. 18 indicates the levelling of the foundation template, and

DESCRIPTION OF THE PREFERRED EMBODIMENTS

Figure 1:
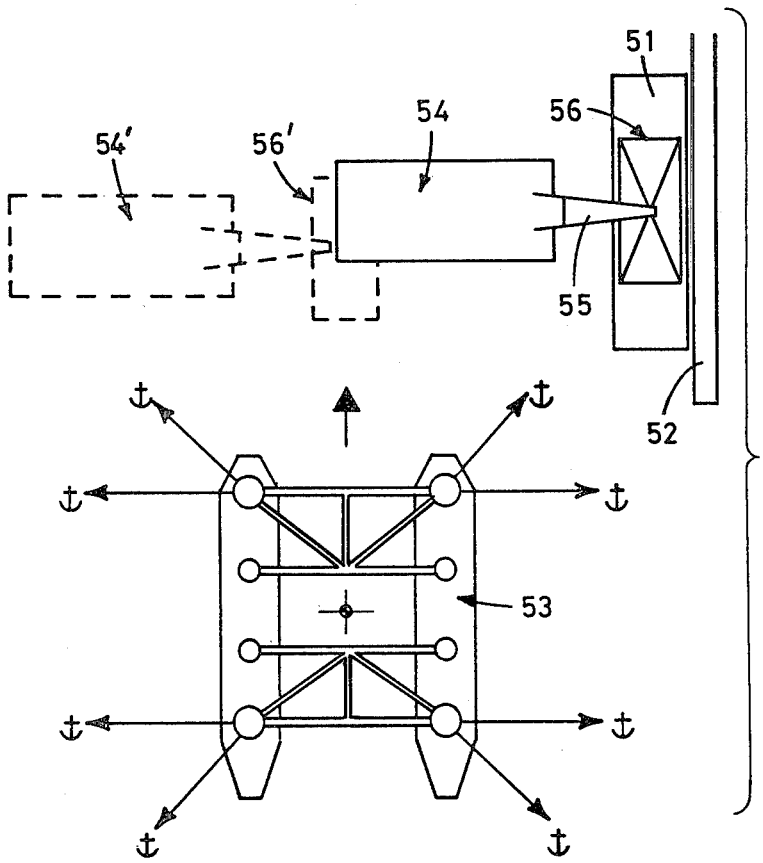
FIG. 1 is a diagrammatic plan view of a semi-submersible drilling vessel adjacent to a quay in sheltered water.
Figure 2:
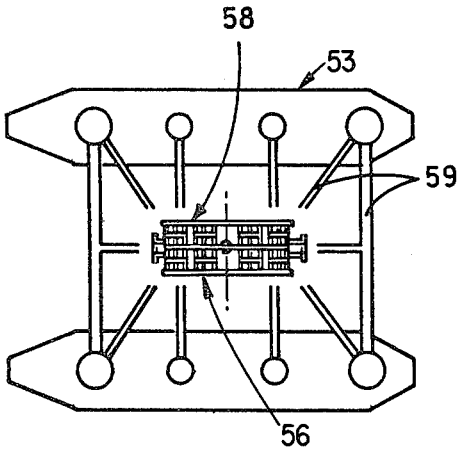
FIG. 2 is a similar view of the semi-submersible with a drilling template in a transportation position.
Figure 3:
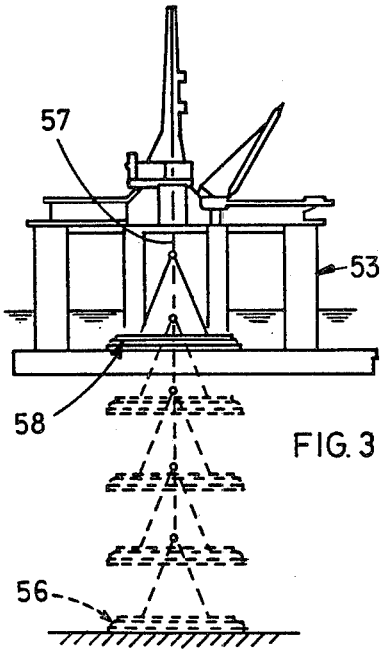
FIG. 3 is a side view of the semi-submersible showing how the drilling template is lifted into the transportation position.

Loading of the drilling template is shown in FIGS. 1–3.

Prior to the load out, the templates will have been brought to the sheltered water on a 'dumb' transport barge 51 (having a deck plan of 60 m × 16 m) which will be berthed alongside a quay 52 prior to the arrival of a vessel comprising a semi-submersible drilling rig 53 such as a type 700 series operated by Sedco, Inc., Dallas, Tex., U.S.A., and with all the lifting slings and ancillaries preslung.

The templates are handled using a crane barge 54. The barge (size 45 × 20 × 3.6 m with 2 m draft) has a 400 tons capacity barge mounted crane 55. It also has a 120 HP 3 speed bowthruster, not shown, for station keeping. The crane barge is berthed alongside the transport barge at a point where its reach can pick up the drilling template 56. Lifting slings and a recovery wire and inflatable recovery buoy are connected to the template.

After the rig 53 enters the sheltered water of a bay (near the inshore base) and has placed its anchors in proper positions, the crane barge picks up the template and manoeuvres to a preselected site in the bay to place the template on the sea bed at position 56'.

The crane barge 54 is then released and moored at a convenient berth outwith the rig anchor pattern to await further use.

With the template resting on sea bed the rig 53 is positioned over the pick-up point on the template as shown in FIG. 2 (which is drawn at right angles to FIG. 1). Using the buoy and recovery wire, the slings are attached to the spiral riser running assembly 57.

The drilling template is then raised to its transportation position 58, see FIG. 3, under the horizontal 6 ft. dia. truss structure 59. Special stab guides and receivers will have been installed prior to raising the template.

Before being handed over to the rig 53, the template should have various items installed for use with the proposed positioning systems, such as one gyro package, one inclinometer package, two Aquafix-3 transducers, four Aquafix-3 transponders (one for each corner), and four closed manometer tube loops with fluid and calibrated sights, one along each side.

Figure 4:
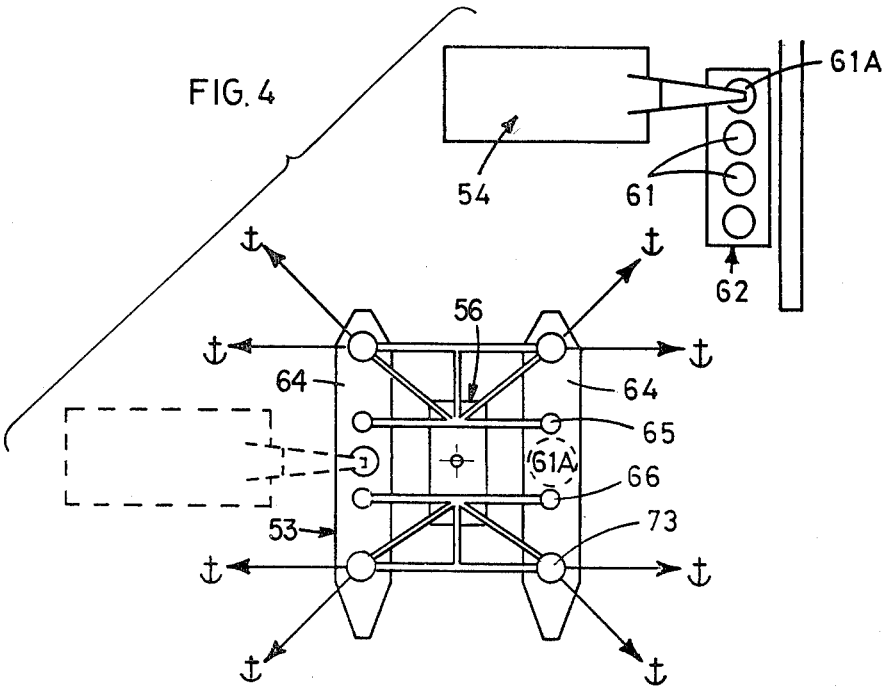
FIG. 4 is a diagrammatic plan view illustrating a foundation template being loaded onto the semi-submersible.
Figure 5:
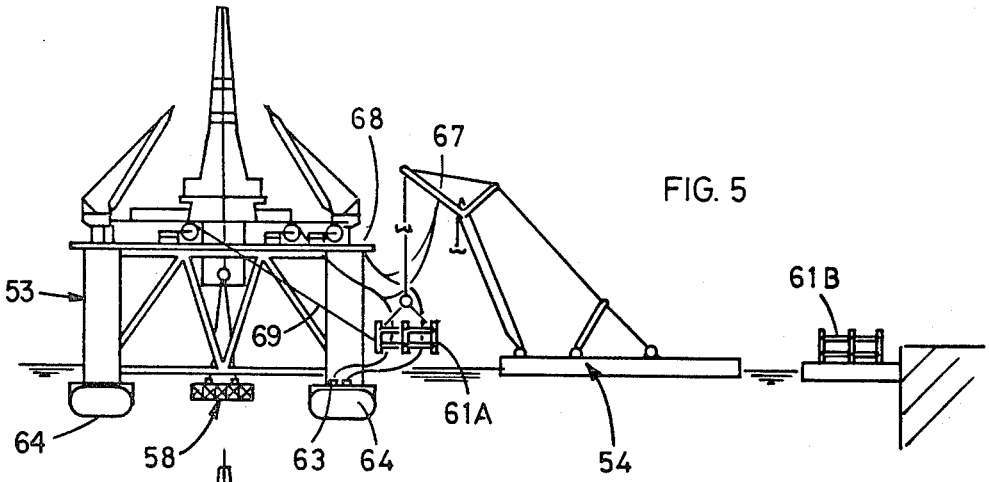
FIG. 5 is a side view showing an intermediate stage in the loading of the foundation template onto the semi-submersible.
Figure 6:
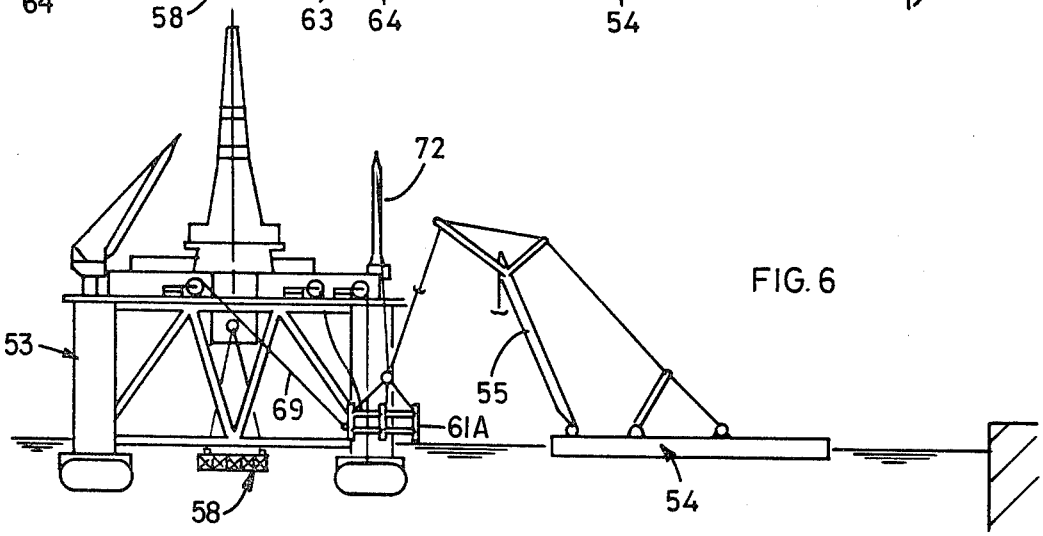
FIG. 6 is a similar view to that of FIG. 5 showing the foundation template being set onto a hull of the semi-submersible.

Loading of the foundation templates is illustrated in FIGS. 4–6.

As previously described it is intended to load out and seafasten all the templates prior to the rig departing for the offshore field.

The loading of the foundation templates continues after the drilling template is loaded and secured for sea.

The four foundation templates 61 are located on a transport barge 62 (which may be the same barge which brought the drilling template to the sheltered water). The crane barge 54 is moved to a position over the lift point of the first template 61A and is connected to the lift sling assembly.

The template is raised with 4 part 3" dia slings in order to install guide stabs which are locked into place.

The guide stabs are placed temporarily into the pile guides on the foundation template to allow the template to be properly aligned onto a transport frame 63 mounted on top of one of the hulls 64 of the semi-submersible rig 53. Once the template is in its stowed position the guide stabs are removed.

The first template 61A is positioned by crane over the transport frame 63 at a point midway between the two starboard 18 ft dia. stability columns 65 and 66. Provision is made for alignment by two guide wires 67 from the main deck 68 to the transport frame 63. A pull back tugger line 69 is used to position the template.

The template 61A is lowered until it is submerged to a floating position. Using ballast control lines the template 61A is ballasted until the guide stabs enter receiver cones 71 in the transport frame 63 as shown in FIGS. 8 and 9. Ballasting conditions after land-out until a maximum of 50,000 lbs net negative buoyancy is obtained. This is measured by use of the starboard deck crane 72 on the rig 53.

The ballast line and guide stabs are removed. The lift sling is removed from the crane and stowed on sling carrier hooks mounted on hanging wires.

A second foundation template 61 is loaded by the same method as for template 61A but the second template 61 will be located between the 30 ft. column 73 and 18 ft. column 66 aft of the centre line.

After the first two foundation templates 61A and 61 have been loaded and are securely seafastened, the loading and sea fastening of the third and fourth foundation template 61 proceeds as outlined above.

The semi-submersible drilling rig 53 is now loaded as shown in FIGS. 7, 8 and 9. The departure of the rig is dependent upon a favourable weather forecast. However, should environmental conditions develop that exceed the 20 ft., 12 second wave it would be necessary to deposit the drilling template.

This could be accomplished prior to the development of these conditions by the following procedure, as shown in FIGS. 10 and 11. A riser running string 74 is set on the riser spider, not shown, and the riser is removed from the special pup, also not shown. Using special chain elevators, sufficient 3" chain 75 in 100 ft. lengths is added to reach the seabed. The template is run to the seabed 76 and the chain is released with a recovery wire 77 and buoy 78 attached. The template can be recovered later in calmer weather.

Assuming favourable weather conditions, the rig carries all five templates out to the offshore field.

When the final position has been obtained, all rig anchors are tensioned up to test at 350,000 lbs. After all anchors have been tested, they are detensioned to 200,000 lbs and the rig 53 is deballasted to 45 ft. draft. At the 45 ft. draft auxiliary lines are installed for levelling services. If wave action is too great, 50 ft. draft is maintained, and the installations are made by surface divers. The rig 53 is then ballasted to 80–90 ft. draft.

Installation of the drilling template 56 is shown in FIGS. 12 to 14.

FIG. 12 shows the rig 53 manoeuvring over the positions for the drilling template 56 and the four foundation templates 61, using wind lasses and anchor chains, not shown.

With the rig 53 on the exact heading for template operation, the template 56 is lowered with the 21" riser string 81 to a depth of 100 ft. using double stands of pre-made up riser. At this point the drilling rig hook and rotary table are unlocked and the template is rotated to the desired heading. With the hook and rotary table locked off, the template is lowered to 10 ft. above sea bed. At this elevation the heading of the template is checked for proper alignment. After any required corrections have been made, lowering is continued. When the template 56 reaches sea bed 82 the weight is slacked off in 50,000 lb increments until all the weight is off the string, then an additional 30 ft is slacked off. When the template is level the lift slings are released and recovered.

Guidance and verification of template positions is planned as a three-phase program:

Phase 1.

Guidance during initial set-down:

(a) Acoustic system for plan location (hard line connections).

(b) Inclinometer and gyro devices (hard line connections) for level and orientation.

Theoretically, the systems should be accurate to within $\frac{1}{3}$ degree of angle and 0.1 m of location. However, experience has shown that in particular situations the acoustic system is susceptible to errors and malfunctions. On the other hand, the system is well-suited to following progress of a template as it moves about on its way down, therefore, it can be used together with an inclinometer/gyro package during initial placement.

Phase 2.

Verification, after set-down:

(a) Inertial Navigation System (INS) for verification of plan location and orientation.

The INS system requires a manned submersible and a support vessel. The submersible carries an inertial nagivation system, comprising a gyro package and a data-processing unit. From signals produced by the gyros, the INS system works out its position continuously based on continuous integration of displacements over time.

The submersible sets out from a fixed reference point such as the corner of a pre-set template. The support vessel has a tracking system which can be used to relate the submersible's location to the vessel location at any instant in time.

The submersible then moves along to other points as required, and gives the new coordinates on demand. The coordinates should be accurate to within 30 cm. Plan orientation of a template can be related to the submersible heading which is accurate to within 0.1 degrees.

Experience has shown the INS system to be very reliable. The cost can be justified due to the various support services which the submersible can provide while in the field.

(b) Manometer tubes across corners for verification of level.

Manometer tubes can be attached to the templates to link three or four corners. Once filled with fluid and calibrated such tubes give very good accuracy with no electrical or mechanical parts to fail.

Ideally, the tubes could be monitored from the surface via TV, however since divers are likely to be present anyway, they might be relied on the make of the readings. The TV surveillance is recommended in order to save time and avoid communication problems.

Phase 3.

Back-up:

Divers can run out hard wire measurements, primarily to check plan locations.

Based on experience, this may not be as accurate as the INS information. Also, the hard wire measurements tell only the distance from one component to another, but do little to describe accurately the plan orientation.

Nevertheless, as divers will be on the scene, the hard wire measurements are proposed as a third back-up system.

When the drilling template 56 has been positioned on the sea bed 82, piles are inserted through pile guides 83 in the template to secure that template to the sea bed.

If the template is more than 2 degrees out of level, a 1.75" dia. tensioner line is connected from a low point on the template to a tensioner assembly described herein in conjunction with FIG. 15 and the template is levelled to within the required accuracy.

A drilling assembly is made up for the first pile hole, selecting a low point on the template for the first pile.

A Conventional drilling procedure can be used for a 36" hole, as shown in FIG. 14.

There are a number of ways that a template may be levelled. The preferred method of template levelling using a heave compensator is as follows:

The drilling template can be levelled with a heave compensator 85 by the method used when compensating for logging equipment. (See FIG. 15.) This procedure starts after all the pin piles have been drilled, run and cemented (as illustrated in FIG. 14) and the hydraulic pod guide lines have been established. The levelling procedure comprises the following steps:

Step 1—Reposition the rig 53 over the centre 86 of the template 56 and let the rig mooring system normalize.

Step 2—Using the 21" riser, run the sling assembly to the template and set the riser string on the spider after ensuring there is enough slack in the slings to compensate for rig heave.

Step 3—Jump the divers to attach the slings to the lifting points on the template 56 and attach. The underwater TV camera 87 can be run in Step 2 on the bottom of the riser with a telescoping frame, or two guide lines can be attached to the template in Step 3 by the divers to run the TV camera frame for guidance. The TV camera will be focused on a levelling pile which will have white bench marks on it so that movement of the template relative to the piles can be observed. A Decca system can be used to indicate that the template is in a level condition.

Step 4—While the divers are attaching the lifting slings remove the bails and elevator from the hook of a heave compensator 85, FIG. 15, and attach an air tugger support assembly 88 to the hook with a bridle assembly which is attached to the top of a lifting frame for the air tugger assembly 88. Pick up the assembly with the travelling block and heave compensator.

Step 5—Pin the bails and elevator to the lifting points on the bottom of the air tugger support assembly and latch the elevator back onto the riser string.

Step 6—Unlock the locking bar of the heave compensator and with the air tugger support assembly and drilling string attached to the hook, raise the travelling block until there is approximately 8 ft. of slack in the lifting slings.

Step 7—Lower the sensing line 83, FIG. 15, through the rotary table 89 to the moon pool 91 and shackle it to one of the pod guide lines, not shown, and run it on to the template; divers then unshackle the sensing line from the guide lines and attach the sensing line to a pre-selected levelling pile 92 to be used as a reference point. Retrieve divers. The constant tension tugger air supply is set to support the weight of the sensing line.

Step 8—Run the hydraulic control pod, not shown via the guide lines and latch the pod into a female pod receptacle which is mounted on the template. Observe procedure with the TV camera 87.

Step 9—Pressurize the heave compensator 85 to about mid-stroke at which point it will take the template weight. Pressurize compensator until template 56 is in a level plane.

Step 10—Focus the TV camera 87 on the reference pile 92 with the white bench marks and observe the movement of the template 56 relative to the pile. Adjust the air supply to the constant tension tugger 88 to increase the tension in the sensing line. Observe the dampening effect on the relative movement between the template and the pile. Increase the sensing line tension until there is no relative movement between the template and the pile. The template is now level and motionless.

Step 11—Re-check level indicating instrument to ensure template level is within the allowable tolerance.

Figure 19:
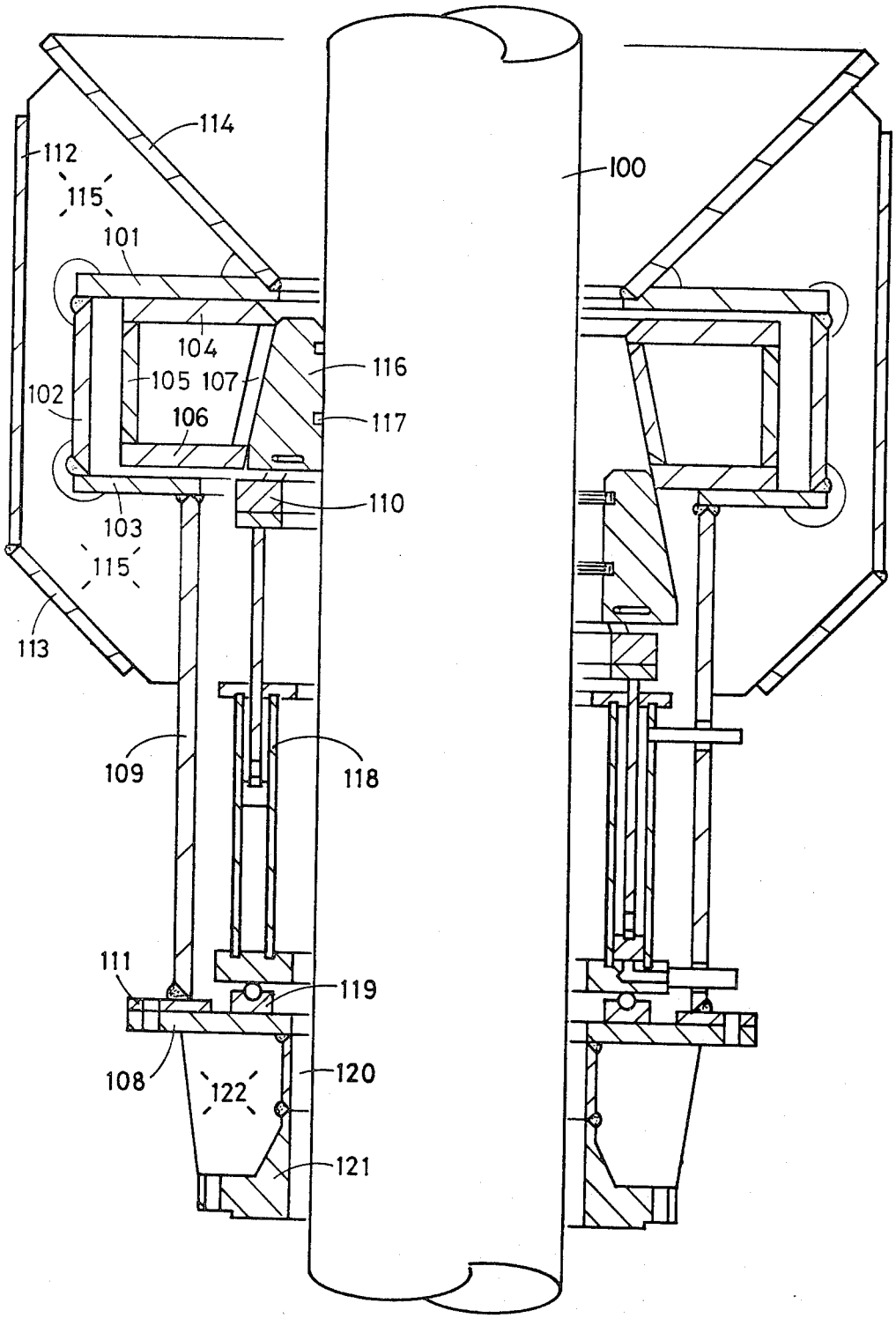
FIG. 19 is a cross sectional view of a pin pile slip assembly, one half of which shows an engaged condition, and the other half of which shows a retracted condition.

Step 12—Activate pile slips from the drillers' panel via the hydraulic control pod. (The slips can be selectively activated) A suitable slip assembly is shown in FIG. 19, and is more fully described following the description of this procedure.

Step 13—Lower traveling blocks to set partial weight of the template onto the slip segments to lock onto the pile. Observe that the slips are set and holding.

Step 14—Slack off total weight of template onto the levelling piles and re-check level of template. If the template level is correct prepare to rig down levelling equipment; if template level is not within the tolerance, pick up on travelling block to take weight of template and retract the slips. Repeat procedure individually until template is level.

Step 15—After template is level and locked to piles, retrieve hydraulic control pod.

Step 16—Jump divers to disconnect lifting slings and sensing line. Divers shackle the sensing line to guide line and the sensing line is retrieved to the moon pool. The sensing line is removed from the guide line and pulled back through the rotary table to the air tugger support assembly. Retrieve divers at the same time.

Step 17—Recover riser running assembly and slings.

Step 18—If necessary re-position rig over piles and grout pile holes back to the top of the template with a cement stringer.

FIG. 19 is a cross-sectional view of a pin pile slip assembly. The left hand half shows the assembly in an engaged condition, and the right hand half illustrates a retracted condition.

The slip assembly is intended to surround a pile 100. There are upper and lower abutment rings 101 and 103 respectively, which are secured to and spaced apart by a tubular wall 102. An annular piston assembly comprises upper and lower plates 104 and 106, spaced apart by an outer tubular wall 105, and a tapered inner tubular wall 107. The annular piston assembly fits loosely between the abutment rings 101 and 103. The lower ring 103 is supported on a base plate 108 by a body tube 109 and mounting ring 111. The base plate 108 is attached to a protector sleeve 120 and a locating flange 121 by eight gusset plates 122.

An outer tubular member 112 surrounds the abutment rings 101 and 103 and is fixed thereto by eight gusset plates 115. Guide cones 113 and 114 are disposed respectively above and below the tubular member 112.

Eight case hardened slip segments 116 are arranged to engage the pile 100 as shown in FIG. 19 (left hand side), but are normally biased outwardly against the tubular wall 107 by two retaining springs 117. An annular hydraulic cylinder 118, mounted on four roller ball housings 119 supported on the base plate 108, is arranged to actuate a slider guide ring 110 vertically within the body tube 109.

In response to increased hydraulic pressures, the slider guide ring 110 moves upwardly, and so moves the outer surfaces of the slip segments 116 against the tapered inner tubular wall 107. Thus the effect of increased hydraulic pressure is to force the slip segments 116 inwardly against the resistance of the retaining springs 117, and into gripping engagement with the pile 100, as the upper plate 104 comes into engagement with the upper adjustment ring 101.

Foundation Template Handing and Installation is illustrated in FIGS. 16–18.

The complete handling system for the foundation templates 61 will have been installed in sheltered water at the inshore base while the templates and other equipment were being loaded onto the rig 53.

Each template 61 will have its own handling system independent of the others to reduce rigging time at the offshore field, where successive template handling systems will be rigged while pile installation operations are in progress.

The drilling template 56, installation of which has already been described, is to be the index for placement of the foundation templates 61. Range and bearing for the foundation templates are derived from a Decca system (or equivalent). Orientation of the foundation templates is effected using the rotary equipment on the rig 53. The final position fix and orientation is determined using a manned submersible with an onboard inertial navigation system (INS), and level is verified with pre-calibrated manometer tubes prior to pile installation.

When the drilling template 56 has been installed and the levelling operations are complete, installation of the first foundation template 61A is commenced.

The rig 53 is ballasted to 35 ft. draft and moved on anchors to position number one. While the move is in progress a 1.5" dia. snub-line 94 is installed from the template 61A to the starboard deck crane 72. The snub-line 94 and a snatch block, not shown, are located in an opening in the main deck at the outboard perimeter girder. The ballast line is recovered and hooked up to vent ballast, and two guide wire tuggers 92 are tensioned. The riser lifting/running tool is connected to the main lift line 95 which was tied off at the moon pool when the templates were loaded at the inshore base.

The template is positioned under the moon pool by venting template ballast until the template 61A floats free of the support frame guides (see FIGS. 8 and 9), with the snug-line and lift lines held taut. The lift line 95 is taken up and the snub line 94 is slackened off until the template is in position under the moon pool 91. Transverse snub-lines may be required depending on sea and current conditions. However, it is possible to hold the template in position by running a very tight lift assembly with 5 to 10 ft. seas and slack tide.

The running operation is commenced using the riser as described for the drilling template installation.

When template is at 100 ft. below sea level the orientation is checked for the required heading. If adjustment is necessary the table and hook are unlocked, the template 61A is rotated to the exact heading, then the running system is locked off and the template is run to the sea bed.

The template 61A is landed on the sea bed and the lift slings are slacked off 30 ft. The manned submersible verifies position and orientation with the INS system, and can also report manometer level readings. if adjustment is required, the slack is taken up and the template shifted or rotated using lifting gear.

The running assembly including the lift line 95 and slings 96 are recovered to commence rigging for the next template.

Referring to FIG. 18, a riser or drill string 57 with screw jack stinger assembly and bumper sub is picked up with one drill collar below the sub. The drill string and assembly are tripped to the template on pre-installed guide lines and an offset frame. The level instrument is consulted to select the low point, and the collar is stabbed in and rotated until the template is level. The sequence is repeated until template is within 0.5 deg. level.

The drill string and screw jack stinger are recovered and rigging for a Hydra Block subsea type pile driving hammer is started.

Handling for the two foundation templates stowed towards the after end of the rig's hulls is slightly different.

The rigging and handling equipment is arranged to allow the aft templates, for example, the template 61B to be maneouvered into position between the two 18 ft dia. stability columns 65 and 66 by the use of a 20 ton "Popeye" winch and a work boat (not shown) tied up alongside the rig. The work-wire is passed from the work boat to the rig and attached to a snub line installed on the template 61B. A "popeye" winch on the rig is taken up until the snub line is taught. Using the ballast method as on the previous template 61A, the template 61B is raised to the surface holding tight on the work wire and tugger. As the template rises the popeye winch is slacked off to allow the template to move to the stern of the boat.

The work boat is shifted to a central mooring position. Using the deck crane 72 the snub line is transferred to the boat and the line is taken up until taught. The work wire from the boat to template is released. The handling lines are taken up and the snub line is slacked off (using the crane and 20 ton winch) until the template 61B is in position under the moonpool 91.

Thereafter the same procedure which was described for the forward stowed foundation templates, for example, the template 61A can be used.

An outline will now be given of the pile driving hammer handling operations necessary to drive the 54" foundation piles.

It should be pointed out that no modifications are required on the rig 53, particularly if the rig is a Sedco 700 semi submersible series drilling vessel to handle an HBM 1500 type pile driving hammer. The addition of certain equipment is necessary, but no structural modifications are anticipated.

The power pack and reels should be on loaded first to allow maximum time to locate and check out. Cable and hose sheaves are required to allow proper access of lines to the moonpool opening.

It is proposed that the primary hammer should be loaded on board in one piece. While the rig is at a dockside the hammer can be loaded with a dock crane with its transport skid on the starboard side. A roller skate system is used to dolly the hammer nto the spider deck area on channel type rails. The hammer can then be hoisted upright in the spider area using the BOP bridge cranes.

This method is preferred because it does not require the primary hammer to be disassembled. The hammer will have gone through a thorough test prior to the loadout. The back-up hammer could be kept in storage in a disassembled condition on the rig 53.

An alternate loadout procedure is to load the primary hammer in three parts and assemble it on the rig in the spider area.

Hammer storage and assembly, if required, can take place in the spider deck area between the moon pool and BOP service pit on the starboard side. This is a convenient location to allow for sea fastening and required work.

The hammer can be moved about in the spider area using the BOP bridge cranes. There are two cranes for BOP handling and both are required to lift and move the hammer. This is a common practice when moving BOP's.

The only hammer modification required is a reduction in height of the lower hammer skirt. The height is reduced by approximately 541 mm. The main function of the skirt is to align the hammer with the follower. A Regan bullseye is attached for visual level indication.

The major equipment additions to facilitate use of the aforementioned hammer and its support equipment are as follows:

(a) Installation of power pack and rig services, such as air and electrical power.
(b) Installation of required sheaves to run hydraulic and electrical cables.
(c) Skid beams and skate dolly for moving hammer from starboard loading position.

The 54" piles each comprise upper and lower halves of approximately equal lengths. Each pile half is approximately 50 feet long. Towards one end of each pile, as near as practical to the end face, there are two lifting pad eyes and combination landing dogs. A smaller pad eye is welded at the opposite end of the pile in between the two large ones. The piles are marked with paint every foot and a full circumferential mark is placed every 10 feet. The two halves can be attached either by mechanical connectors or by welding.

Loadout of the piles can be accomplished by either crane. However, it may be preferred not to loadout all of the piles together, but rather to use the available deck load capacity to carry a combination of piles and bulk stored drilling materials.

Each crane has the lift and reach capacity to land one 50 ft. pile length in the pipe rack area. The cranes do not have the capacity to place a 50 ft. pile length on the center of the dragway. The crane can load the piles on the outboard edge of the pipe rack and the piles must then be rolled to the edge of the dragway using tuggers.

To land a pile on the false rotary, the following procedure is adopted:

(a) With the lower pile half at the edge of the pipe rack next to the dragway, both cranes are required to lift the pile and place it in the V-door and on the dragway.

(b) The tugger at the end of the dragway is used with a double sheave block to provide a multi-part line to the back of the pile half going into the V-door. This will allow a constant tension to be applied to the pile half while it is going into the derrick. This addition will have its greatest value when the lower end is ready to swing into the drill floor area, after it has been lifted off the pipe ramp.

(c) Slings are attached from bail hooks to the lifting pad eyes on the pile half. The pile half is eased into the derrick while keeping a strong tension on the dragway tugger. As the lower end of the pile comes into the drill floor area all available tuggers are used to keep it under control.

(d) The pile half is lowered and landed on the false rotary beams provided. If guide lines are used they are attached to the pile half at this time.

(e) The cranes should have the upper pile half ready to be raised in the derrick by the same procedure.

(f) The upper pile half should be raised in the derrick using the same slings and procedure.

(g) The upper pile half is carefully lowered over the lower pile half and the two halves are connected together.

(h) (i) If mechanical connections are used the vendors make-up tools should be used to accomplish the connection and permanently locked using vendors instructions.

(ii) If the two halves are to welded together they are joined using an appropriate welding procedure.

(i) After the two pile halves have been connected the complete pile assembly is lifted and the support dogs on the lower pile half are removed.

(j) The pile assembly is lowered and landed on the dogs on the upper pile.

To land a pile on the work platform the following steps are taken:

(a) The slings are removed and replaced with slings which will reach to the work platform on the BOP guides below.

(b) The assembled pile is picked up and rotated through 45 degrees for the pile dogs to clear the false rotary beams. The pile is lowered and landed on the dogs of the work platform on fixed BOP guides.

To attach the hammer to the pile the following procedure is used:

(a) Using the bridge crane on the rig 53 the hammer follower is picked up and attached to the pile using shear pins.

(b) The pile is picked up using the rig bridge cranes, and the support dogs on upper pile half are cut off. The pile is landed smoothly on dogs located on the follower on the work platform.

(c) The hammer is picked up with the bridge cranes and set on partially closed spider beams in approximately the well center.

(d) The hammer running assembly (from the bottom up) consists of:

(i) Universal joint with pin connection to hammer and $6\frac{5}{8}$ regular tool joint.

(ii) Three bumper subs with minimum 5 ft. stroke each with $6\frac{5}{8}$ regular tool joints.

(iii) X-over from 8 inch drill collar to 5 inch drill pipe.

(iv) 5"-135 drill pipe to blocks.

(e) The insert is placed in false rotary beams to handle drill pipe. The running assembly is picked up and attached to the hammer with a pin on the U-joint.

The assembly is run to the sea bed as follows:

(a) The hammer and pile assembly is picked up, the work platform is retracted on the BOP guides and the bottom of the pile is to run to 50 ft. above the sea bed. The hose bundle is strapped to the drill pipe every 50 ft.

(b) Move rig over template and locate desired slot, lower assembly until TV vision indicates pile has contacted mud line. Raise TV to watch Regan bubble on hammer. Continue to lower and alternate position of TV from template to Regan bullseye. Continue to lower until soil resistance begins to pick up weight. At this point a constant watch must be kept on the bubble.

The pile is then driven as follows:

(a) When the pile is self-standing due to its own weight penetration, the tension is slacked off and the lower two bumper subs are allowed to collapse. The upper sub is spaced out to allow for vessel heave.

(b) Low power blows are applied to the hammer, (approx. 25%) and the bumper subs are spaced out while visual checks are made.

(c) Driving is started, watching the bumper sub spacing, and occasionally checking for penetration. The shear pins between follower and pile will be sheared.

(d) For the last 5 to 10 ft. of driving, the bumper subs are spaced out and the pile is watched at the template. Driving ceases when the proper pile elevation is reached.

(e) The hammer is retrieved and the same procedures are applied for the next pile.

No rig modifications are required to handle the 54 inch diameter pile, but rig additions include additional tuggers in the pipe rack area to handle moving piles. A work platform on fixed BOP guides is needed in the moon pool, and additional stiffeners are required to the tie back this platform to substructure. A false rotary with insert is necessary to handle the drill pipe and drill collars.

Template levelling is done according to the template manufactures incorporated system. It should be noted that if the bottom conditions allow the template initially to be excessively out of level, the template will have to be levelled prior to hammer driving.

Cementing the annulus between the template and each 54" diameter pile is accomplished with the use of a small diameter stinger run on the end of drill pipe. The stinger is inserted in the annulus and as much penetration as possible obtained. As cement is pumped into the annulus any over displacement will fall into the I.D. of the 54 inch pile.

Cleaning the I.D. of the 54 inch pile should be done prior to drilling the 20 inch diameter hole. This can be accomplished by two methods:

(a) A 48 inch diameter jetting assembly can be used in the 54 inch pile to jet the 100 feet required. The 48 inch O.D. stinger needs to be only a few feet in length and can then be tapered to a smaller O.D., e.g. 42 inch. The small annulus clearance should give a good washing action as the stinger is jetted.

(b) An underreamer with approximately 52 inch arms having large jet nozzles could be used to open the I.D. The sizing of the jet nozzles would allow large volumes of drilling fluid to pass but produce only a sufficient pressure drop to "just keep the arms extended" to prevent the tool binding. A modification would have to be made to the underreamer arms to prevent damage by the metal to metal contact with the 54 inch pile. Bearing pads could be welded to the arms to give a low friction bearing surface. The underreamer arms can also be locked to approximately 48" diameter.

20" pile drilling and installation is carried out in the following manner. Drilling the 26 inch hole for the 20 inch pile is done in a manner similar to normal drilling for 20 inch casing. Entering the 54 inch pile I.D. can be accomplished with or without guide lines being established. If the choice is made not to use guide lines, the funnel diameter on the template should be of sufficient size to allow re-entry.

Drilling the 26 inch hole will require initial stabilizers to assure a vertical hole. It is proposed that an expendable type stabilizer (such as rubber or plastic) be used on the drill pile, to ensure initial verticality. It would be necessary to have one spaced out near the bottom of the 54 inch pile and one near the top; this will give many feet of hole at zero degrees. Depending on the type of stabilizer chosen, the drill pipe may have to be tripped out to remove the stabalizer if the parts do not come apart when they meet the 26 inch diameter hole.

If stabilizers are not used, a potential angular discrepancy of approximately 1.15 degrees could exist.

Special care must be given to the initial portion of the hole to ensure verticality. Low bit weight and sufficient RPM will be chosen to enhance the straight hole. The hole will be overdrilled by a sufficient length to prevent any problems.

Cementing the annulus between the 26" hole and 20" pile can be done with existing techniques used in offshore drilling of 20" casing. A standard float shoe can be welded to the bottom of the 20 inch pile and a stinger can be connected to the running tool on the 20 inch pile at the top end.

Cementing the ID of the 20 inch pile can be accomplished after cementing the annulus. When the running tool is disengaged from the pile the stinger can come out of the float shoe. As the stinger is slowly brought to the surface, cement can be pumped into the I.D. of the 20 inch pile. When the stinger has reached the surface any surplus cement can be washed away by pumping seawater through the stinger.

I claim:

1. A method of installing a subsea template at a predetermined site on a seabed comprising the steps of:

providing a semi-submersible drilling vessel having a pair of spaced apart submersible hulls, a deck supported above said hulls and connected to said hulls by frame means of said vessel, and hoisting apparatus on said vessel extending through an opening in said deck between said hulls;

providing at least one subsea template having a fixed area greater than said opening in said deck;

positioning said template with respect to said vessel beneath said deck and between said hulls and lifting said template with said hoisting apparatus to a transport position beneath said deck and between said hulls;

securing said template to said vessel;

moving said vessel and said template to said site; and lowering said template from said vessel to said seabed.

2. The method set forth in claim 1 wherein:

said step of positioning said template with respect to said vessel comprises placing said template on the seabed in sheltered water, moving said vessel into a position over said template, connecting said hoisting apparatus to said template, and lifting said template to said transport position beneath said deck.

3. The method set forth in claim 1 or 2 wherein:

said vessel includes drill stem rotating means and said hoisting apparatus includes elongated riser means adapted to be rotated by said rotating means, and said method of installing said template at said site includes the steps of positioning said vessel on the sea at said site, lowering said template with said riser means, rotating said template with said riser means and said rotating means to a predetermined heading; and further lowering said template to set down said template on said seabed.

4. The method set forth in claim 3 together with the step of:

verifying the position of said template on said seabed after set down of said template.

5. The method set forth in claim 3 together with the step of levelling said template on said seabed by:

providing an air tugger connected to one end of a sensing line and supported by a heave compensator connected to said hoisting apparatus;

connecting the other end of said sensing line to a pile for securing said template to said seabed;

lifting said template and tensioning said sensing line to dampen the motion of said template with respect to said pile; and securing said template to said pile when said template is level and said template becomes substantially motionless with respect to said pile.

6. The method set forth in claim 5 including the step of providing said template with at least one pile slip assembly and engaging said pile with said slip assembly to secure said template to said pile.

7. The method set forth in claim 1 including the steps of:

providing at least one other subsea template to be installed at a predetermined site on said seabed;

providing at least one of said hulls with frame means for supporting said other template;

placing said other template on said one hull and secured to said frame means before departing with said vessel to said site;

repositioning said vessel at said predetermined site for said other template after installation of said one template;

removing said other template from said one hull with said hoisting apparatus and positioning said other template under said deck; and lowering said other template to its predetermined site on said seabed.

8. The method set forth in claim 7 wherein:

said other template is adapted to be buoyant and is ballastable to rest on said one hull under its own weight when said one hull is submerged, and said method includes the steps of ballasting said other template upon placement on said frame means to a negative buoyancy condition;

deballasting said other template to a positive buoyancy condition after connecting said other template to said hoisting apparatus; and removing said other template from said one hull by floating said other template off of said frame means; and positioning said other template under said deck with said hoisting apparatus.

9. The method set forth in claim 7 including the steps of:

providing said vessel with secondary hoisting apparatus above said one hull;

connecting a snub line from said secondary hoisting apparatus to said other template, and maintaining tension on said snub line while floating said other template off of said one hull and during the positioning of said other template under said deck.

10. The method set forth in claim 7 together with:

providing at least four foundation templates including said other template;

placing two of said foundation templates on one of said hulls and two of said foundation templates on the other of said hulls, and repositioning said vessel prior to installing each of said foundation templates over respective installation sites on said seabed for each of said foundation templates.

11. The method set forth in claim 1 including the steps of:

providing said template with lifting chain means, a recovery wire and a buoy;

temporarily abandoning said template by lowering said template to the seabed with said chain means and said recovery wire connected to said chain means and said buoy, disconnecting said chain means from said vessel, and
recovering said chain means and said template with said hoisting apparatus when sea conditions permit transportation of said template to said site.

12. A method of installing a subsea template at a predetermined site on a seabed comprising the steps of:
providing a semi-submersible drilling vessel having a pair of spaced apart hulls, a deck supported by and between said hulls, and hoisting apparatus and drill stem rotating means on said vessel, said hoisting apparatus including elongated drill stem riser means adapted to be engaged by said drill stem rotating means and extending through an opening in said deck;
providing at least one subsea template larger in fixed area than said opening in said deck;
placing said template on the seabed in sheltered water;
moving said vessel into a position over said template;
connecting said hoisting apparatus to said template;
lifting said template to a transport position beneath said deck and between said hulls;
moving said vessel and said template to said site;
lowering said template from said vessel toward said seabed;
rotating said template with said riser means and said drill stem rotating means to a predetermined heading; and
setting said template on said seabed at said heading.

13. A method of installing one or more subsea templates at preselected sites on a seabed comprising the steps of:
providing a semi-submersible drilling vessel including spaced apart submersible hulls including means for ballasting said hulls to selectively vary the draft of said vessel and means for supporting a template on at least one of said hulls, a deck supported above and by said hulls, primary hoisting apparatus on said vessel for raising and lowering a riser through a moon pool on said vessel and spaced laterally from said one hull, and secondary hoisting apparatus on said vessel including cable means adapted to be connected to said template;
providing at least one submersible template adapted to have controllable positive and negative buoyancy;
loading said template on said support means on said one hull using a crane and at least one of said hoisting apparatus on said vessel to position said template over said support means;
lowering said template onto said support means and ballasting said template to shift the weight of said template to said support means;
transporting said template to a predetermined site on said seabed with said vessel;
connecting said template to said primary and secondary hoisting apparatus;
venting ballast from said template while maintaining said one hull at a depth sufficient to float said template free of said support means and while controlling the position of said template with said hoisting apparatus;
positioning said template under said moon pool with said primary and secondary hoisting apparatus; and
lowering said template to said seabed with said primary hoisting apparatus.

14. The method set forth in claim 13 together with:
providing at least four foundation templates including said one template;
placing two of said foundation templates on one of said hulls and two of said foundation templates on the other of said hulls, and repositioning said vessel prior to installing each of said foundation templates over respective installation sites on said seabed for each of said foundation templates.

15. The method of installing a plurality of subsea templates at preselected sites on a seabed comprising the steps of:
providing a semi-submersible drilling vessel including spaced apart submersible hulls, frame means for supporting a deck above and between said hulls, drill stem hoisting apparatus on said vessel for raising and lowering a riser through a moon pool on said vessel spaced laterally from and between said hulls, and secondary hoisting apparatus on said vessel including cable means;
providing a drilling template;
providing at least three submersible foundation templates adapted to have controllable positive and negative buoyancy;
positioning said drilling template on said seabed in relatively shallow sheltered water;
moving said vessel into position over said drilling template;
lifting said drilling template with said hoisting apparatus to a transport position between said hulls;
loading said foundation templates seriatim on support means on at least one of said hulls using a crane and at least one of said hoisting apparatus on said vessel to position said foundation templates over said support means;
lowering said foundation templates onto said support means and ballasting said foundation templates to shift the weight of said foundation templates to said support means;
transporting said templates to a predetermined site on said seabed;
positioning said vessel at said site, lowering said drilling template to said seabed, and disconnecting said hoisting apparatus from said drilling template;
repositioning said vessel over a site for a foundation template;
connecting one of said foundation templates to said hoisting apparatus;
venting ballast from said one foundation template to float said template free of said support means while controlling the position of said template with said hoisting apparatus;
positioning said one foundation template under said moon pool with said hoisting apparatus;
lowering said one foundation template to said seabed with said drill stem hoisting apparatus and disconnecting said drill stem hoisting apparatus from said one foundation template; and
repeating the steps of repositioning said vessel, connecting another of said foundation templates to said hoisting apparatus, venting ballast, positioning said other foundation template under said moon pool, lowering said other foundation template and disconnecting said drill stem hoisting apparatus for each of the remaining foundation templates.

* * * * *